United States Patent [19]

Buder et al.

[11] 4,168,823

[45] Sep. 25, 1979

[54] SEALS FOR THE INLET AND OUTLET OF A CONTINUOUS STRIP FURNACE

[75] Inventors: Thomas E. Buder, Godfrey, Ill.; Theodore C. Murray, St. Louis, Mo.

[73] Assignee: Olin Corporation, New Haven, Conn.

[21] Appl. No.: 943,334

[22] Filed: Sep. 18, 1978

Related U.S. Application Data

[63] Continuation of Ser. No. 809,978, Jun. 27, 1977, abandoned.

[51] Int. Cl.[2] ..... C21D 9/56

[52] U.S. Cl. ..... 266/102; 266/110; 34/242

[58] Field of Search ..... 34/242; 266/44, 102, 266/110; 432/242

[56] References Cited

U.S. PATENT DOCUMENTS

| | | | |
|---|---|---|---|
| 890,314 | 6/1908 | Thompson | 266/102 X |
| 1,624,204 | 4/1927 | Baily | 266/102 X |
| 1,696,900 | 1/1929 | Baily | 432/242 X |
| 2,367,174 | 1/1945 | Renkin | 266/102 X |
| 4,064,713 | 12/1977 | Sando et al. | 34/242 X |

FOREIGN PATENT DOCUMENTS

| | | | |
|---|---|---|---|
| 491706 | 2/1976 | U.S.S.R. | 266/110 |

*Primary Examiner*—Paul A. Bell
*Attorney, Agent, or Firm*—Paul Weinstein

[57] ABSTRACT

A method and apparatus is disclosed for sealing the inlet and outlet of a continuous strip furnace so as to minimize oxygen infiltration into the furnace, prevent heat loss from the furnace and to make the seals readily accessible for repair and replacement.

6 Claims, 6 Drawing Figures

SEALS FOR THE INLET AND OUTLET OF A CONTINUOUS STRIP FURNACE

This is a continuation of application Ser. No. 809,978, filed June 27, 1977 now abandoned.

BACKGROUND OF THE INVENTION

For years both the builders and users of continuous strip furnaces and other strip processing lines have been attempting to devise a better way of sealing both the inlet and/or outlet of this equipment. This invention relates to a method and apparatus for positively sealing the inlet and/or outlet of both vertical and horizontal continuous strip furnaces.

Conventional continuous strip furnaces are known to be equipped with air curtain type seals. Such seals have been found to be quite ineffective. As a result of the ineffective sealing which occurs on continuous strip furnaces which employ air curtain type seals, a number of problems and disadvantages are experienced.

It is desirable in conventional annealing furnaces to keep the annealing atmosphere relatively free from oxygen infiltration. It has been found that, as a result of ineffective sealing on conventional furnaces employing air curtain type seals, oxygen can readily infiltrate the annealing atmosphere. By having excess oxygen in the annealing atmosphere, the annealed product will fail to have the desirable bright finish. Thus the product will require a greater pickling time to produce the desired finish than would be required if the product was annealed in a relatively oxygen-free environment. Such a process suffers from the disadvantages of being time consuming and costly.

A further disadvantage resulting from ineffective sealing on conventional strip furnaces is the loss of heat which occurs. With the soaring costs and limited availability of energy producing fuels, it is extremely costly and undesirable to operate a strip furnace with ineffective sealing.

One technique for sealing an annealing furnace has been known for some time, however, it has been shown to have a number of disadvantages. This technique is illustrated in U.S. Pat. No. 890,314, to H. L. Thompson, wherein the inlet of the furnace is sealed by flap-type seals bearing against the metal strip which is to be treated.

Certain problems arise when sealing an annealing furnace in the manner exemplified by Thompson. Specifically, the particular location of the seals on the inlet of the furnace are such that the replacement of the seals is difficult since the seals are actually located inside the body of the furnace proper. A similar difficulty occurs on the outlet of the furnace, more specifically, the seal formed by flexible gates 20 and 21.

SUMMARY OF THE INVENTION

In accordance with this invention, an improved sealing means is disclosed which is readily adaptable to be used on conventional continuous strip furnaces. It has been found that improved sealing of the inlet and/or outlet of conventional furnaces may be attained by providing means to seal the face of the top entry and/or bottom exit rolls. The seal means employed may take the form of a mating roll placed next to the top and/or bottom roll so that the face of each roll substantially meet to form a positive seal. Naturally, the seal means need not be limited to a mating roll but could take any form which would produce effective sealing such as a flap-type seal or pivoted plate.

The seal of this invention possesses certain advantages over the conventional air curtain type seal in that oxygen is prevented from infiltrating the annealing atmosphere. A further advantage is the prevention of heat loss from the furnace. An additional advantage is that by enclosing the furnace inlet in the manner disclosed in the present invention, the furnace proper becomes longer and therefore the annealing capacity of the furnace is increased. Another advantage to this new inlet concept is that supplemental heating means could be installed in the new enclosed area for strip preheat.

Furthermore the seal of this invention possesses definite advantages over the seal arrangement exemplified by the Thompson patent. The location of the seals as set forth in the present invention are such that replacement and repair is easily accomplished. Furthermore, the seal of the present invention has a further advantage in that it minimizes the number of parts necessary to form a seal by employing the idler rolls to form part of the seal.

Accordingly, it is a principal object of the present invention to provide an efficient and economical method of sealing the inlet and/or outlet of a continuous strip furnace.

It is a further object of the present invention to provide a seal which would effectively prohibit the infiltration of oxygen into the furnace atmosphere.

It is yet a further object of the present invention to provide a seal for a continuous strip furnace which would substantially eliminate heat loss from the interior of the furnace.

It is still another object of the present invention to provide a seal which is easily accessible for replacement and repair.

Other objects and advantages will become apparent to those skilled in the art from a consideration of the description which proceeds with reference to the following drawings.

DETAILED DESCRIPTION

In accordance with the present invention, the foregoing objects and advantages are readily attained.

The method of this invention comprises sealing the top entry and/or bottom exit roll of a conventional continuous strip furnace by maintaining a seal means in proximate contact with the face of the rolls. The seal means is pivotally mounted so that it can move back from the face of the rolls when the stitched strip ends pass therebetween.

The seal means is loaded in such a manner as to be urged toward the face of the rolls. The apparatus will be described in greater detail hereinbelow.

Figure 1:
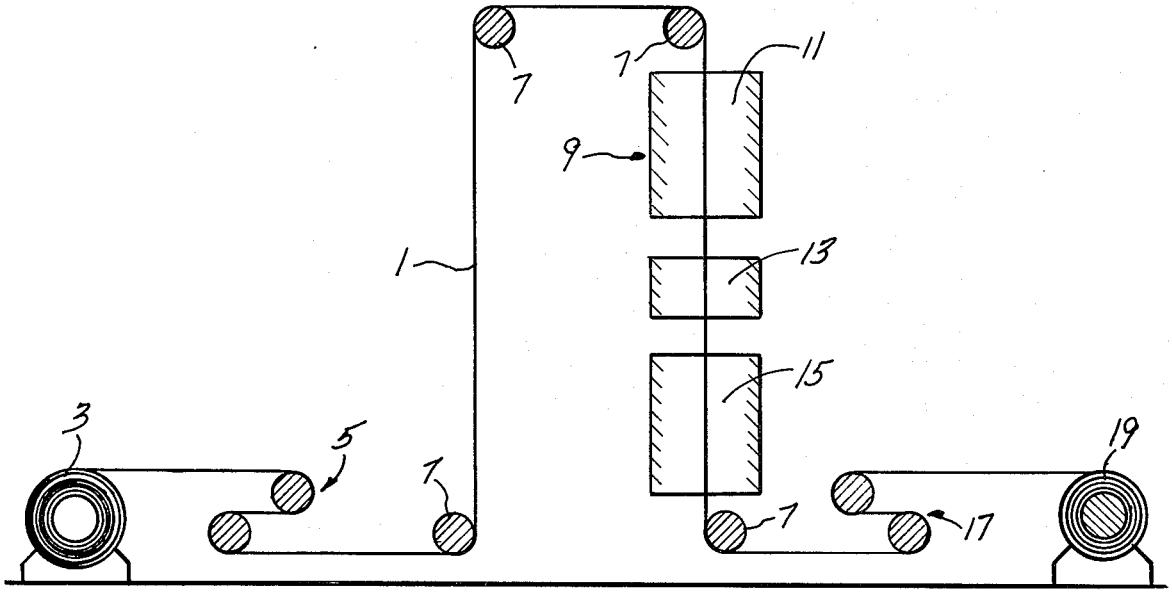
FIG. 1 is a schematic view in side elevation of a typical process line which could employ the seal of the present invention.

A typical process line on which the principles of the present invention can be employed is shown in FIG. 1. A metal strip 1 which is to be treated is unwound from roll 3. The strip is threaded through wrapped roll bridle 5 which controls the entry and line speed of the strip. Various idler rolls 7, including top entry and bottom exit rolls, are provided as shown to set the path of the strip through the furnace 9. At the entry end of the furnace is a heating zone 11 through which the metal strip passes. The strip next passes through a holding zone 13, and from there it passes through cooling zone 15. Upon emerging from the furnace the strip passes through exit wrap bridle 17. After treatment the strip is recoiled on motorized reel 19.

Figure 2:
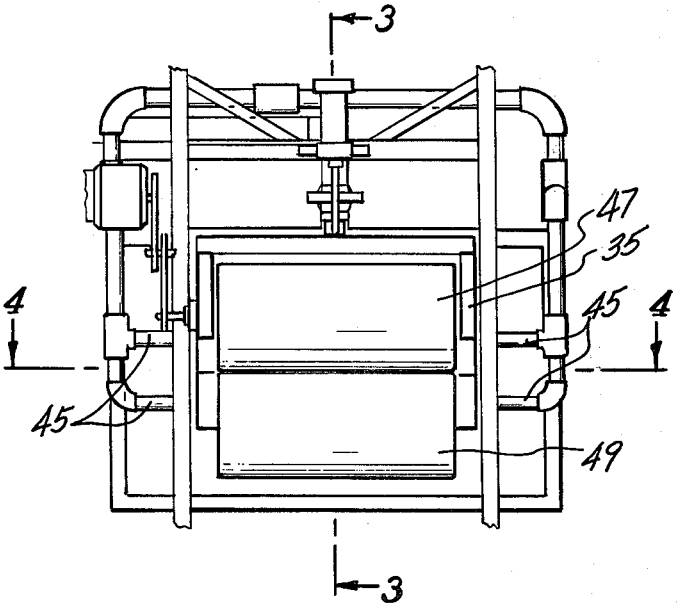
FIG. 2 is a top view of the inlet of a continuous strip furnace employing the principles of the present invention.
Figure 4:
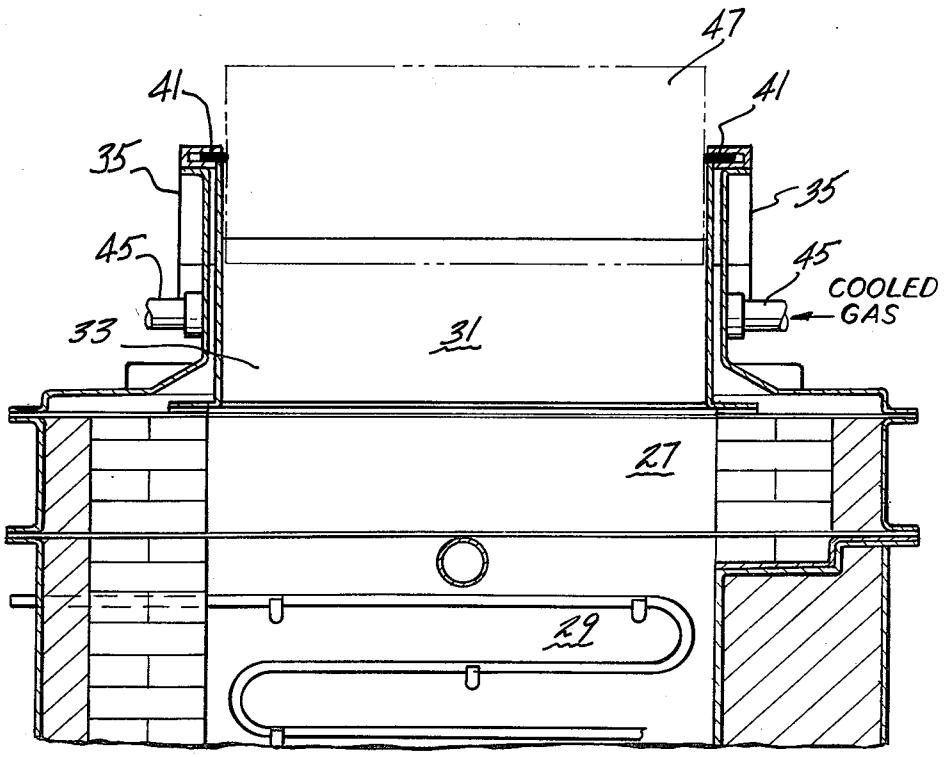
FIG. 4 is a view taken along the line 4—4 of FIG. 2 showing the details of a seal means of the present invention.
Figure 3:
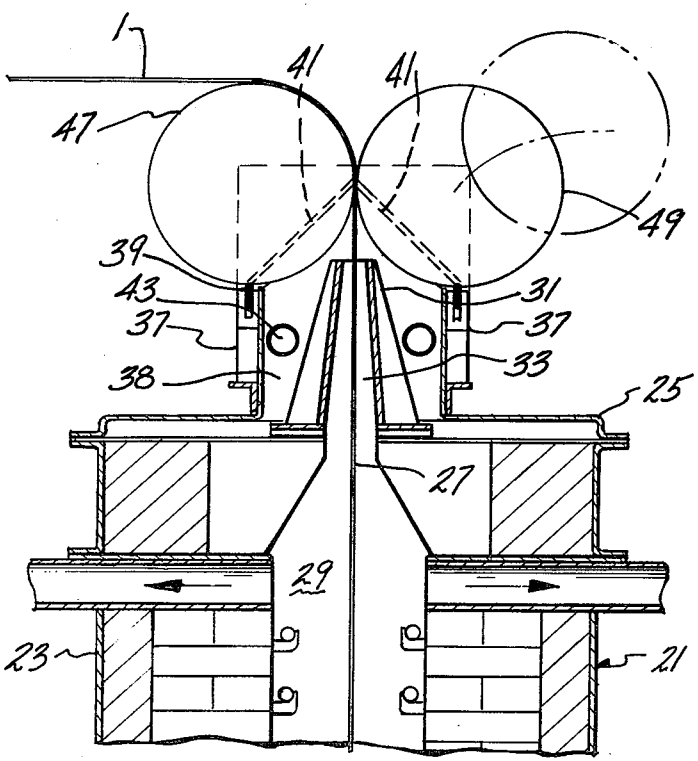
FIG. 3 is a view taken along the line 3—3 of FIG. 2 showing the details of a seal means of the present invention.
Figure 5:
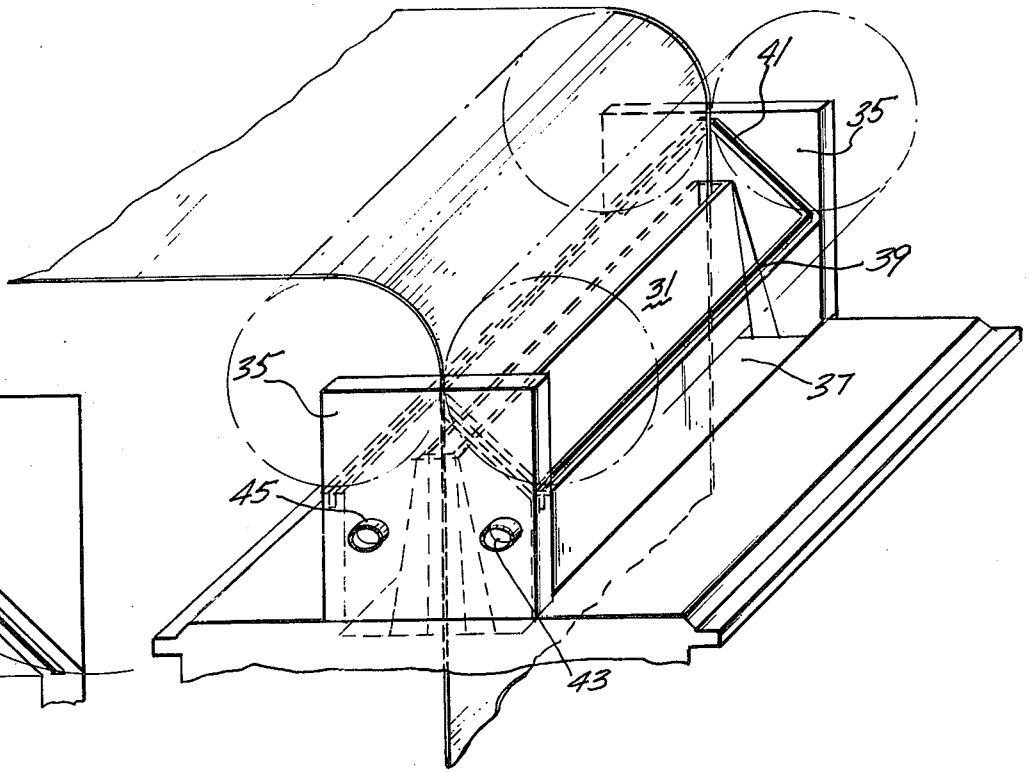
FIG. 5 is a perspective view showing the details of a seal means of the present invention.
Figure 6:
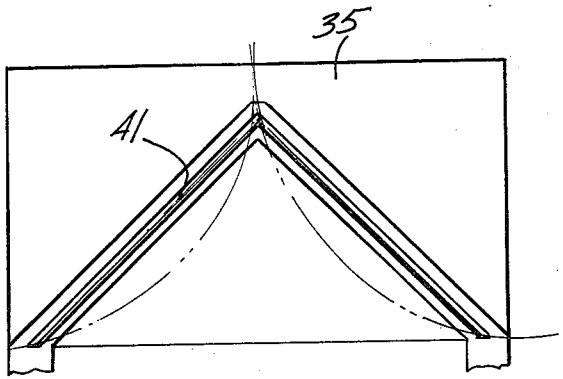
FIG. 6 is a detailed view of the end walls on the inlet of the furnace.

FIGS. 2 through 4 illustrate the inlet of a conventional vertical continuous strip furnace employing the principles of the present invention. Furnace 21 comprises side walls 23 and top wall 25 in which is formed elongated inlet 27 which communicates with the interior 29 of the furnace. Mounted integrally on the top wall 25 of the furnace is an elongated truncated cone 31 which, as seen in FIG. 3, is formed with an elongated passage 33 leading to furnace inlet passage 27.

Referring further to FIGS. 2 through 4, the elongated truncated cone 31 is enclosed on its four sides by end walls 35 and side plates 37 forming an enclosed space 38. As will be seen in greater detail in FIG. 3, mounted on the top of side plates 37 are seal means 39 such as wipe plates. Other material could be used in place of wipe plates such as stainless steel brushes or fluoro plastic sheets such as Teflon®. End walls 35, as illustrated in FIGS. 2 and 4 are also provided with seal means 41 such as wipe plates. End walls 35 are provided with openings 43 which are connected to pipes 45 for purposes to be set forth below. Rotatably mounted above the furnace in a conventional manner, not illustrated, is top entry idler roll 47 which aids in guiding the metal strip 1 through passage 33, inlet 27 into the interior 29 of furnace 21. The idler roll 47 may be mounted for rotation in any conventional manner. For example, the roll may be fixedly mounted on a shaft which is journalled in bearings mounted in the end walls. The top idler roll is driven by the moving strip, at strip speed, as a result of the 90° contact wrap of the strip with the roll.

As is clear from FIGS. 3 and 4, the idler roll 47 is mounted in such a manner as to be in proximate contact with the seal means 39 of one of the side plates 37 and furthermore be in proximate contact with seal means 41 formed on the end walls 35. In accordance with the present invention, the idler roll 47, when mounted in the above-described manner, is substantially sealed on its end walls and face by seal means 41 and 39, respectively. The seal means 41 and 39 should contact each other at a point where the end walls and side plates meet. It should be noted that it is not necessary that the seal means be in actual contact with the idler roll surfaces in order to form an effective seal as long as a gap of no more than 1/32" is maintained.

FIGS. 2 through 4 are illustrative of one preferred embodiment employing the principles of the present invention. In accordance with the principles of the present invention, and for reasons set forth below, a mating roll 49 is rotatably mounted in a pivoted bracket, not shown, in a conventional manner. For example, the mating roll may be fixedly mounted on a shaft which is journalled in bearings mounted on brackets which are pivotally secured to the top wall of the furnace. The pivoted brackets are loaded in any conventional manner, such as by springs, counterweights, magnets or any other equivalent manner, so as to urge the mating roll into proximate contact with the idler roll. The mating roll may be driven at strip speed by either a separate drive motor or by the metal strip fed between the idler roll and mating roll.

As is clear from FIGS. 3 and 4, the mating roll 49 is mounted so as to be in proximate contact with the seal means 39 and 41 on the side plate 37 and end walls 35, respectively, in the same manner as previously set forth for idler roll 47. In addition, the face of mating roll 49, under the influence of the above-described load means, is urged into proximate contact with the face of idler roll 47. The mating roll 49, when mounted in the above-described manner, cooperates with idler roll 47, end walls 35 and side plates 37 to substantially seal enclosed space 38 from the atmospheric environment. While the surfaces faces of idler roll 47 and mating roll 49 need not be in actual contact with each other in order to form an effective seal, it is desired that the gap between the two surfaces be no more than ¼".

The seal means must be of a material having a low coefficient of friction, good wear qualities and capable of withstanding temperatures up to 250° C. One such material available is a fluoro plastic such as Teflon®.

The remaining components of this apparatus are fabricated from materials capable of withstanding the elevated temperatures which arise from operation of continuous strip furnaces.

The operation of the foregoing-described apparatus is as follows.

The metal strip to be treated is fed over the top entry roll 47 through passage 33, inlet 27 into the interior 29 of furnace 21. The inlet is substantially sealed from atmospheric environment by the mating faces of the two rolls which seal on the metal strip, the end faces of each roll which seal with the wipe plates on the end walls and the mating face of each roll with its respective wipe plate located on the side plate. The fact that the brackets that support the mating roll are pivotally mounted allows the mating roll to back off the strip when the thickness of the metal strip increases, as is the case when the strip ends, which are stitched together, pass between the rolls. The mating roll will be urged back toward the idler roll after the passage of the strip stitch under the influence of the load which is applied to the pivoted brackets. The enclosed space 38 is fed with cooled gas from the furnace atmosphere under pressure via pipes 45. The furnace has a recirculatory fan for the cooling zone and a recirculatory fan for the heating (annealing) zone. A branch line, from the main recirculatory fan cooling zone duct work, presently supplies cold atmospheric gas to various parts of the entire system. One of these present ports is the furnace inlet area for make up and cooling. This supply can still serve the furnace inlet area and with a slight piping modification pressurize the furnace inlet in its entirety. The presence of the pressurized gas in the enclosed space serves two functions. The gas cools both the top and mating roll and, secondly, the pressurized enclosure aids in preventing air from being drawn into the furnace environment.

Though the foregoing description has proceeded with reference to a particular mating roll sealing apparatus, the present invention should not be so limited, as variations in the sealing apparatus are contemplated within the scope of the principles of the present invention. Thus, a pivoted plate could be employed in lieu of the mating roll. Likewise, a flexible flap-type seal could be employed. In addition, the bottom exit roll can be sealed in a like manner as could the entrance and exit roll in any conventional strip furnace.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a continuous strip treating furnace having an annealing chamber with an end inlet and an end outlet for said strip, end sealing means for said chamber comprising the combination of a first rotatable roll fixedly mounted on an end of said chamber for guiding the said strip through the furnace, a movable rotatable mating roll pivotally mounted adjacent to said first roll, and means urging said movable roll toward said first roll to contact the said strip and press it between the said roll surfaces, thereby substantially sealing the said chamber against the entry therein of ambient atmosphere.

2. A continuous strip treating furnace according to claim 1 wherein the said end sealing means are at the chamber inlet.

3. A continuous strip treating furnace according to claim 1 wherein the said end sealing means are at the chamber outlet.

4. A continuous strip treating furnace according to claim 1 wherein the said end sealing means are at both the chamber inlet and outlet.

5. A continuous strip furnace according to claim 1 wherein said sealing means for said chamber further include wipe plates fixed to chamber end wall members, said wipe plates extending from the said wall members into the space adjacent to the said rolls.

6. A continuous strip furnace according to claim 1 further comprising means for feeding gas under pressure around said strip within said chamber end so that gas leaving the said chamber flows over the said strip and roll surfaces, thereby preventing the entry of ambient atmosphere into said chamber.

* * * * *